US007197797B2

(12) United States Patent
Janczak et al.

(10) Patent No.: US 7,197,797 B2
(45) Date of Patent: Apr. 3, 2007

(54) METHOD FOR MANUFACTURING A VEHICLE DOOR HINGE

(75) Inventors: Wojciech Janczak, Commerce Township, MI (US); Craig Spalding, Sterling Heights, MI (US); Jonathan Smith, Bloomfield Hills, MI (US)

(73) Assignee: Edscha North America, Pontiac, MI (US)

( * ) Notice: Subject to any disclaimer, the term of this patent is extended or adjusted under 35 U.S.C. 154(b) by 494 days.

(21) Appl. No.: 10/320,136

(22) Filed: Dec. 16, 2002

(65) Prior Publication Data

US 2004/0111834 A1 Jun. 17, 2004

(51) Int. Cl.
*B21D 53/40* (2006.01)
*E05C 17/64* (2006.01)

(52) U.S. Cl. ..... 29/11; 29/437

(58) Field of Classification Search ..... 29/11, 29/437; 296/146.11; 16/221, 356, 337, 16/237, 372, 379

See application file for complete search history.

(56) References Cited

U.S. PATENT DOCUMENTS

| | | | | | |
|---|---|---|---|---|---|
| 7,439 | A | * | 6/1850 | Holmes | 16/385 |
| 183,459 | A | * | 10/1876 | Holmes | 16/372 |
| 1,319,427 | A | * | 10/1919 | Soss | 16/372 |
| 1,575,030 | A | * | 3/1926 | Behn | 29/11 |
| 1,772,560 | A | * | 8/1930 | Soss | 16/250 |
| 2,201,968 | A | * | 5/1940 | Fischer | 16/372 |
| 2,799,042 | A | * | 7/1957 | Hollansworth | 16/335 |
| 3,188,685 | A | * | 6/1965 | Fletcher | 16/342 |
| 4,141,107 | A | * | 2/1979 | Sheiman et al. | 16/221 |
| 4,949,427 | A | * | 8/1990 | Keller | 16/335 |
| 5,038,436 | A | * | 8/1991 | Ihrke | 16/249 |
| 5,598,607 | A | * | 2/1997 | Katagiri | 16/337 |
| 6,178,599 | B1 | | 1/2001 | Worden et al. | 16/386 |

FOREIGN PATENT DOCUMENTS

| | | | |
|---|---|---|---|
| DE | 296 21 946 U | | 3/1997 |
| FR | 2 431 592 | | 2/1980 |
| GB | 1399532 | * | 7/1975 |

OTHER PUBLICATIONS

"Saturn Rad Coupe Third Door Hinge Prototype" (5 sheets).

* cited by examiner

*Primary Examiner*—Marc Jimenez
(74) *Attorney, Agent, or Firm*—Davidson, Davidson & Kappel, LLC

(57) ABSTRACT

A method for manufacturing a vehicle door hinge having a hinge axis, the method including providing a first hinge part having a first arm and a second arm axially spaced from the first arm, the hinge axis passing through the first arm and the second arm. The method also includes bending a strip of material to form a second hinge part having a first end, a second end, and a bent section between the first end and the second end, the first end having a first section and the second end having a second section, the first section and the second section being parallel relative to one another. In addition, the method includes fixing the first section and the second section relative to one another, and disposing the bent section between the first and second arms about the hinge axis.

30 Claims, 8 Drawing Sheets

METHOD FOR MANUFACTURING A VEHICLE DOOR HINGE

BACKGROUND OF THE INVENTION

The present invention relates generally to a method for manufacturing hinges and more particularly to a method for manufacturing vehicle door hinges.

Vehicle door hinges are typically made from two hinge parts pivotable with respect to one another about a hinge pin. One of the hinge parts is securely mounted to a door and the other to the vehicle body, so that the door can pivot about the hinge pin between an opened and closed position. The typical process for manufacturing both of the hinge parts is a stamping process. The stamping process, although widely used in the production of vehicle hinge parts, is expensive compared with other production methods because it entails significant waste of material. When high quality materials are used for the parts, the cost of the wasted material can be significant. Casting has also been used to manufacture hinge parts of this type, though casting is also an expensive production process for hinges of this type.

In many vehicle hinges, both hinge parts are shaped so that the hinge pin passes perpendicularly through holes drilled in the stamped metal hinge parts. In other vehicle hinges, at least one of the hinge parts is shaped to include a sleeve for receiving the hinge pin longitudinally. For example, one known horizontal axis hinge for a lift gate includes a hinge part stamped from a strip of metal approximately 6 mm thick. During the manufacturing process, a bent portion is formed by stamping an end of the strip of metal around to form a hook, so that the edge almost abuts against the flat section of the strip to form a sleeve for receiving the hinge pin. The edge of the strip of metal is welded to the flat section of the strip at the end of the hook. The inside of the hook portion is machined out to form an inside diameter for fitting the hinge pin, which passes longitudinally through the hook.

A vehicle door hinge faces certain forces during use. For example, for vertical axis hinges for vehicle side doors, the weight of the door and any other vertical forces placed on the door, particularly in the opened position, create forces on the hinge that may cause deflection of the hinge, such as a vertical deflection, or sag. In addition, when the door is in its fully opened position and an additional force in the opening direction is placed on the door, a torque about the axis of the hinge is created. This situation, referred to as an over-open condition, may cause an angular deflection in the hinge.

BRIEF SUMMARY OF THE INVENTION

An object of the present invention is to provide a method for manufacturing a vehicle door hinge that can be performed at low cost, while still providing a hinge with acceptable strength characteristics.

The present invention provides a method for manufacturing a vehicle door hinge having a hinge axis. The method includes providing a first hinge part having a first arm and a second arm axially spaced from the first arm, the hinge axis passing through the first arm and the second arm. The method also includes bending a strip of material to form a second hinge part having a first end, a second end, and a bent section between the first end and the second end, the first end having a first section and the second end having a second section, the first section and the second section being parallel relative to one another. In addition, the method includes fixing the first section and the second section relative to one another, and disposing the bent section between the first and second arms about the hinge axis.

In addition, the method may also include connecting the first and second hinge parts may be connected using a hinge pin disposed along the hinge axis. A hinge pin insertion component disposed in the bent section may be used to provide a fixed inner diameter for the hinge pin.

A longitudinal opening, preferably being triangular, may be defined adjacent the first and second sections by the first end and second end. In addition, an insert may be provided between the first end and second end. The first section, second section, and insert are preferably fixed together. The insert may be made of a different material than the strip of material and is preferably made of a certain grade of steel with the strip of material being made of a higher grade of steel. A flange may be formed on the insert and the insert may be provided so that the flange is disposed around at least one of the first end and the second end.

The first and second sections may be welded to each other. The bending may also be performed so that the bent section and an end of the insert form a cylinder about the hinge axis.

The method may also include attaching one of the first and second hinge parts to the door. A first hole may be formed in the first end, and a second hole in the second end and a first attachment device, which may be a bolt, passing through the first hole and the second hole may be used in attaching to the door. The first hole may also be formed in the first section the second hole in the second section. A further hole may be formed in the first end, and which may open into the longitudinal opening, for receiving a second attachment device. A second further hole may be formed in the second end for receiving the second attachment device. The strip of material preferably has a thickness 4 mm or less.

The present invention also provides a method for manufacturing a vehicle door hinge having a hinge axis, that includes providing a first hinge part and bending a strip of material so as to create a second hinge part. The bending is performed so as to form a first section defining an aperture about the hinge axis between first and second end, and a second section defining a longitudinal opening with a longitudinal axis parallel to the hinge axis. The method also includes connecting the first hinge part with the second hinge part using a hinge pin disposed along the hinge axis.

The longitudinal opening is preferably triangular and the strip of material preferably has a thickness of 4 mm or less.

In addition, the present invention provides a method for manufacturing a vehicle hinge having a hinge axis, including providing a first hinge part, and bending a strip of material so as to form a second hinge part having a bent section about the hinge axis intermediate to a first end and a second end. The method also includes disposing an insert between the first end and the second end, and connecting the first hinge part with the second hinge part using a hinge pin disposed along the hinge axis.

Moreover, the present invention also provides a method for manufacturing a vehicle door hinge having a hinge axis that includes providing a first hinge part having a first arm and a second arm axially spaced from the first arm, the hinge axis passing through the first arm and the second arm and roll-forming a strip of material so as to form a second hinge part having a first end, a second end, and a bent section between the first end and the second end, the bent section defining an aperture. The method also includes disposing the bent section between the first and second arms so that the hinge axis passes through the aperture and so that the second hinge part is rotatable with respect to the first hinge part. The roll-forming may include cold-roll forming. The method may also include mounting the second hinge to a vehicle body so that the hinge axis is vertical.

Alternately to the roll forming process, a force slide machine, such as that manufactured by Bihler, may be used.

BRIEF DESCRIPTION OF THE DRAWINGS

Several embodiments of the present invention are elaborated upon below with reference to the accompanying drawings, in which.

DETAILED DESCRIPTION

Figure 1:
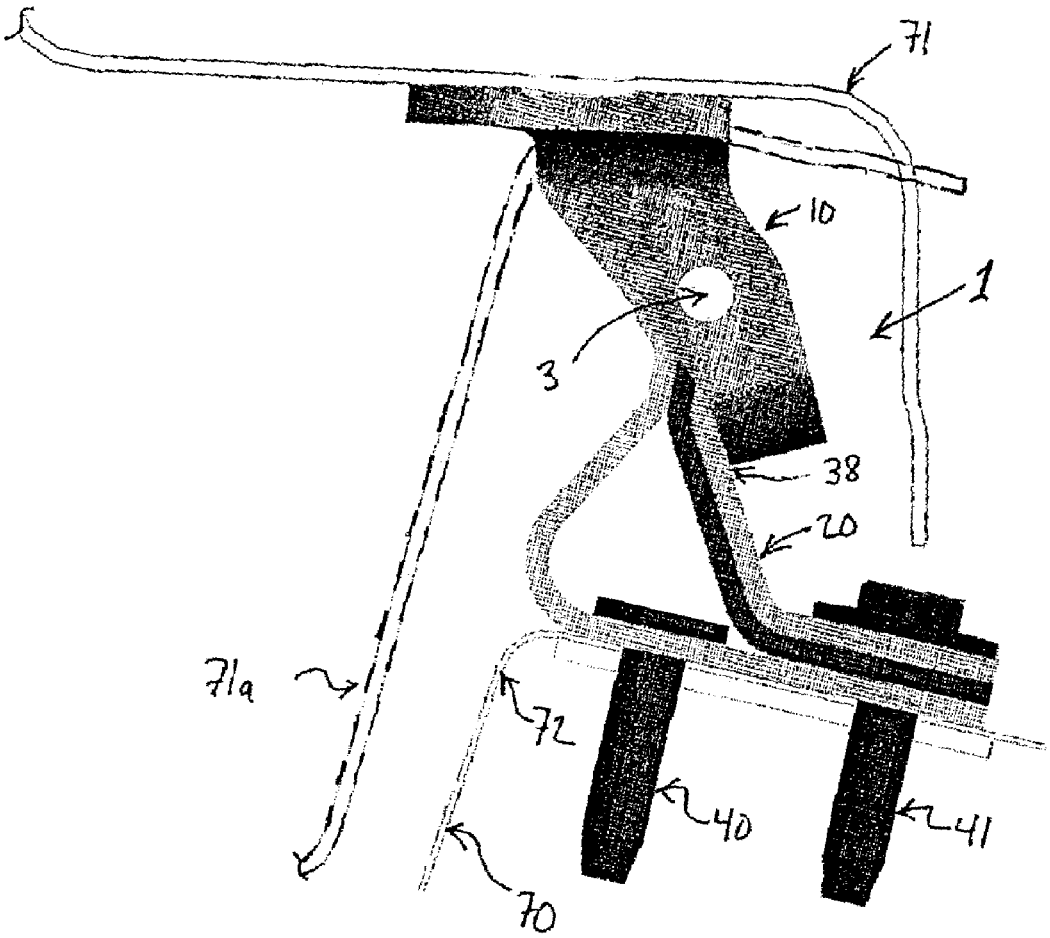
FIG. 1 shows a side view of a vehicle door hinge according to the present invention in an opened position.

A motor vehicle door hinge 1 according to one embodiment of the present invention is shown in FIG. 1. The door hinge 1 includes a first hinge part 10 mounted to vehicle door 71 of vehicle 70. The door hinge 1 preferably is for a passenger side door of a vehicle, but could also be for other vehicle doors, for example as a lift gate.

Second hinge part 20 is mounted to a body portion 72 of vehicle 70 using bolts 40 and 41 or other suitable attachment devices. Hinge pin 3 connects first hinge part 10 to the second hinge part 20 so as to enable the first hinge part 10 to pivot about a hinge axis of the hinge pin 3 relative to second hinge part 20, thereby opening and closing vehicle door 71 relative to the vehicle body 72. The hinge axis may be vertical where the door 71 is a passenger side door, and horizontal where the door 71 is a lift gate. Vertical, as defined herein, means substantially vertical and may include up to several degrees deviation from perfect vertical. FIG. 1 shows door 71 in a fully opened position. Dashed lines indicated by reference number 71*a* show the position of vehicle door 71 in a fully closed position. Although the preferred embodiment of FIG. 1 shows the first hinge part 10 mounted to the vehicle door 71 and the second hinge part mounted to the vehicle body 72, it is possible to reverse that arrangement. Thus, the first hinge part 10 could instead be mounted to the vehicle body 72 with the second hinge part mounted to the vehicle door 71.

Figure 2:
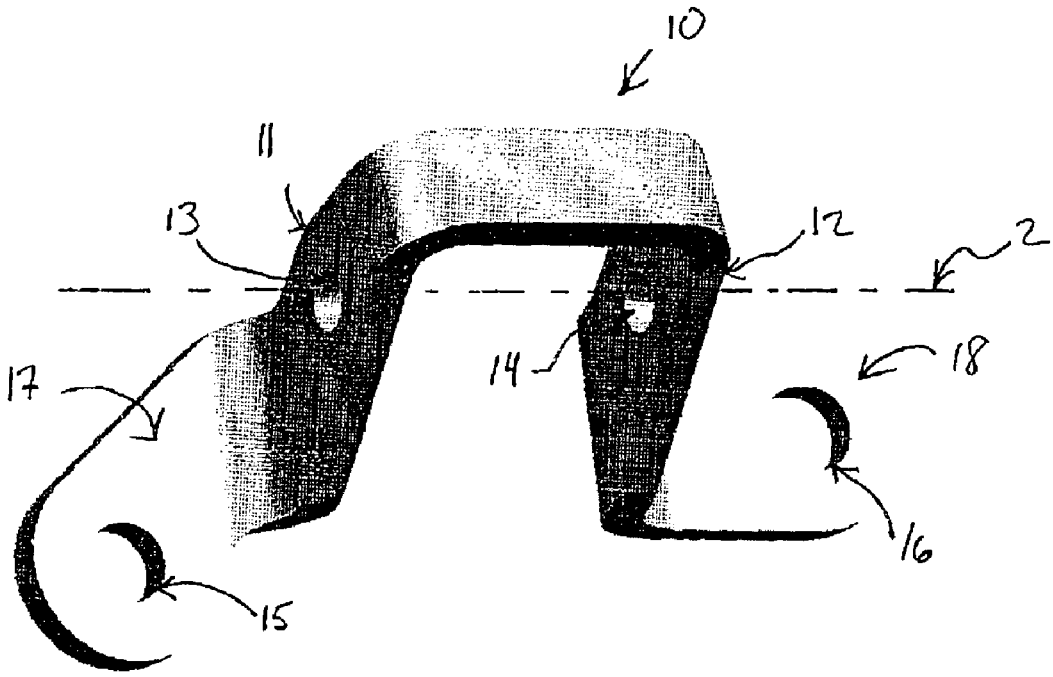
FIG. 2 shows a perspective view of a first hinge part of the vehicle door hinge of FIG. 1.
Figure 14:
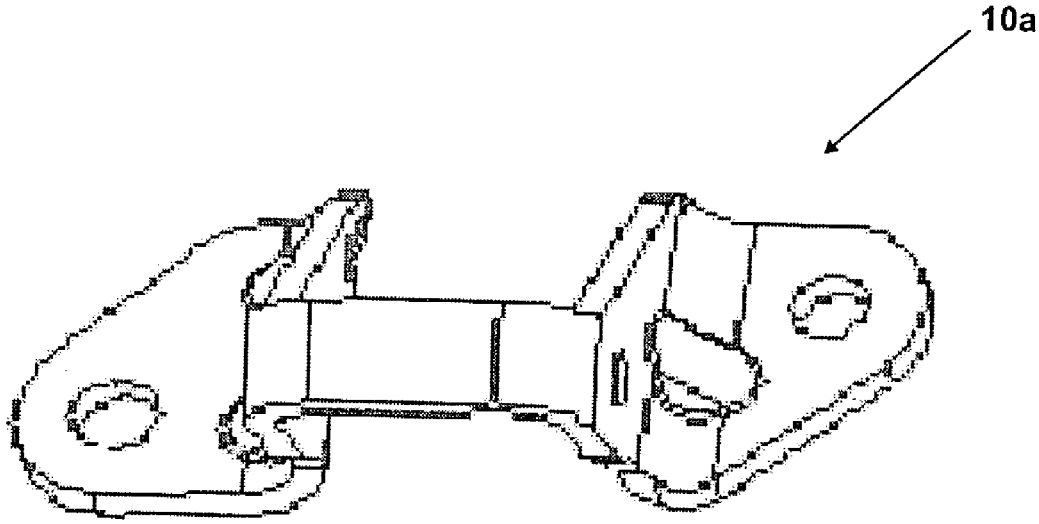
FIG. 14 shows an alternative embodiment of the first hinge part shown in FIG. 2.

FIG. 2 shows the first hinge part 10 separately from the rest to the hinge and vehicle. As shown, first hinge part 10 includes a first arm 11, and a second arm 12 spaced axially from the first arm with respect to hinge axis 2. Each arm includes a hinge axis hole 12, 13 disposed concentrically with respect to the hinge axis 2, for receiving a hinge pin. The first arm also includes a mounting section 17 with mount hole 15 and the second arm includes mounting section 18 with mount hole 16 for mounting the first hinge part 10 to the vehicle door 71 (or the vehicle body 72, as the case may be), via bolts or other attachment devices. First hinge part 10 may be shaped by stamping. An alternative first hinge part 10*a*, as shown in FIG. 14, may be used in place of hinge part 10.

Figure 3:
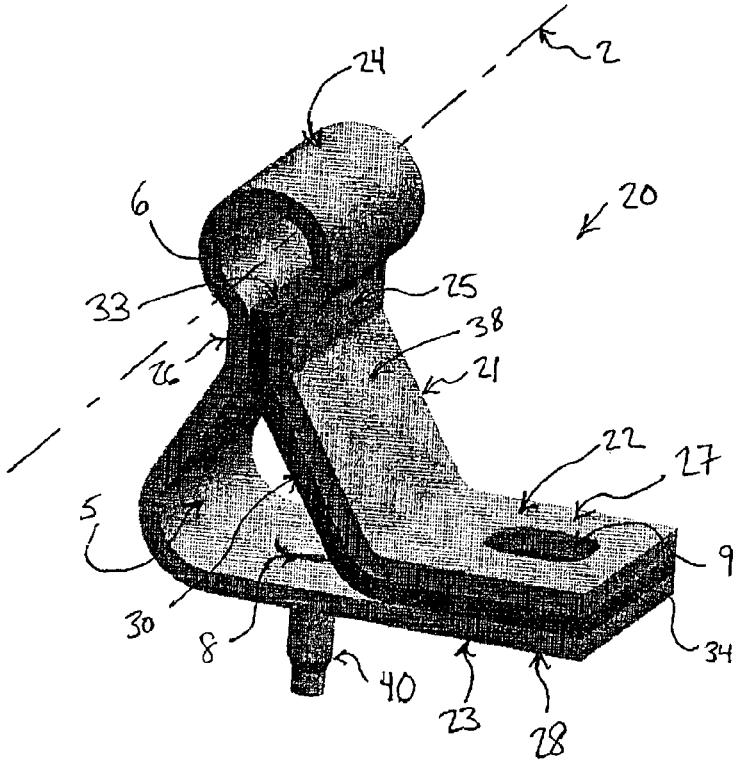
FIG. 3 shows a perspective view of second hinge part of the vehicle door hinge of FIG. 1.

FIG. 3 shows a more detailed view of second hinge part 20, which includes continuous strip of material 21. An insert 30 fits between ends 22, 23 of the strip 21. Continuous strip 21 is preferably made of a high strength low alloy (HSLA) steel, for example 950 HSLA steel. In a preferred embodiment with 950 HSLA steel, the thickness of strip 21 is 3 mm, but the thickness can vary according to the method of fabrication of hinge part 21 and the desired characteristics of the hinge. Preferably, the thickness for 950 grade HSLA steel is 4 mm or less, so as to aid the bending of the strip 21. A bent section 24 is formed between first and second ends 22, 23 of strip 21 around hinge axis 2 to create longitudinal pin aperture 6 for receiving the hinge pin 3. The width of continuous strip 24 in the direction of the hinge axis 2 is such that the bent section 24 fits between the first and second arms 11, 12 of first hinge part 10 (FIG. 2) when the hinge is assembled.

Adjacent to bent section 24, first end 22 of continuous strip 21 includes first section 25, which is disposed parallel to second section 26 of second end 23. The first and second sections 25, 26 are fixed relative to one another, for example by laser welding each section to insert 30. Further toward the bottom of second hinge part 20, first end 22 also includes a third section 27 and second end 23 includes a fourth section 28. Third and fourth sections 27 and 28 are likewise disposed parallel to one another and are fixed to one another. Between the parallel regions—created by first and second sections 25, 26 and third and fourth sections 27, 28—first end 22 and second end 23 diverge from one another to form a longitudinal opening 5. The longitudinal opening 5 between two regions of parallel fixed regions of the strip 21, provides excellent strength characteristics for the hinge part. Preferably, the shape of the opening, which is triangular in this embodiment, may be formed to include surface 38 positioned so as to provide a stop for first hinge part 10 when the door is in the fully opened position. This is shown in FIG. 1. The stop provided by surface 38 may work in conjunction with, or independently from an additional door stop, for example, as provided by a separate door check device.

Insert 30 is disposed between first and second ends 22, 23 of continuous strip 21. In this particular embodiment, insert 30 is disposed adjacent to first end 22 of strip 21 for the entire length of insert 30. The insert 30, which may be made of a metal, such as steel, imparts additional strength and rigidity to second hinge part 20. A first end 33 of insert 30 preferably terminates at the bent section 24 of the continuous strip so as to form a portion of the longitudinal pin aperture 6, which in this embodiment is cylindrical. The insert 30 is fixed relative to the continuous strip 21, preferably by laser welding. Preferably, the insert 30 is at least welded to both the first and second ends, 22, 23, of continuous strip 21 in the region of the first and second sections 25, 26 and in the region of the third and fourth sections 27 and 28. A second end 34 of the insert 30 may terminate so as to be approximately flush with the termination of the first and second ends 22, 23, of the continuous strip 21.

In one preferred embodiment, the second hinge part 20 is mounted to the vehicle body 72 and includes the continuous strip 21 and insert 30, which are each 3 mm thick. The continuous strip 21 is made from 950 grade HSLA steel and the insert 30 is made from 980 HSLA steel. The continuous strip 21 and the insert 31 maybe for example 32 mm wide, and are preferably between 30 and 40 mm wide for a vehicle side door. The first hinge part 10 is mounted to a door of the vehicle 71 and is stamped from 5 mm 950 HSLA steel.

Continuous strip 21 can be formed by bending into the desired shape using cold-roll forming, but can also be fabricated using other suitable fabrication methods such as rotary force sliding. To better resist corrosion, the strip of material may be pre-galvanized, zinc plated, or made of non-corrosive material, such as stainless steel.

The continuous strip 21 can be formed from a continuous band of material that is fed in line with or without inserts, shaped, and then cut off from the continuous band of material. Alternately, the continuous strip 21 may be cut off the continuous band before shaping or may be pre-formed as magazine piece.

Figure 11:
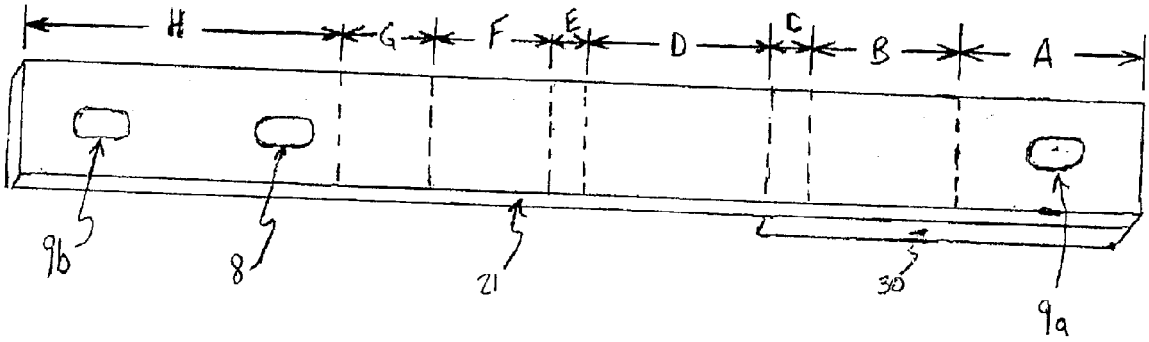
FIG. 11 shows a continuous strip of material for a second hinge part before bending.
Figure 12:
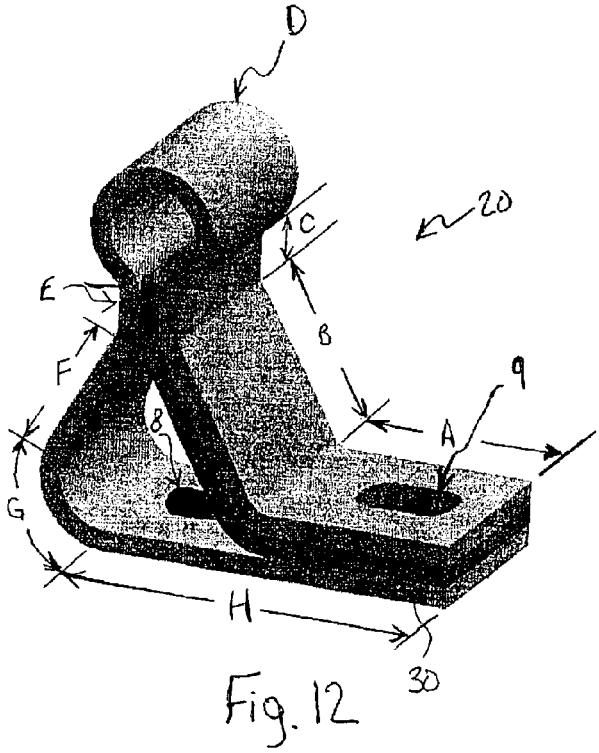
FIG. 12 shows the continuous strip of material of FIG. 11 after a bending operation has been performed.
Figure 13:
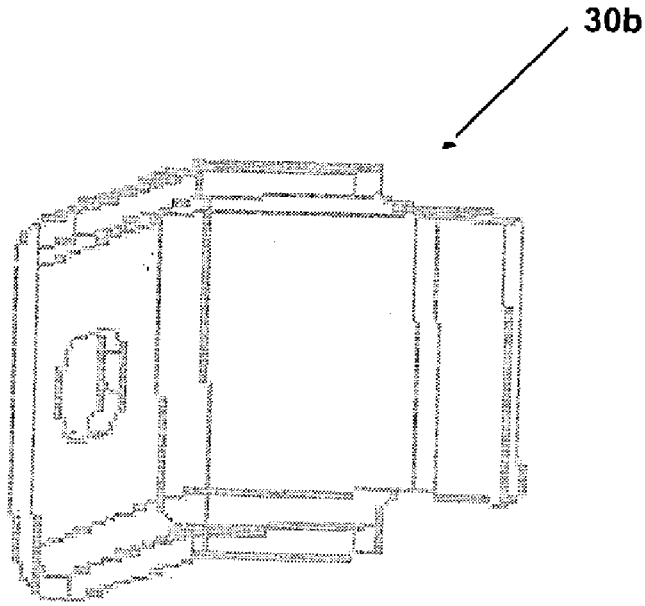
FIG. 13 shows a further alternative embodiment of the insert for the vehicle door hinge shown in FIG. 3.

FIG. 11 shows such a preformed magazine piece, i.e. continuous strip 21 is shown before any bending has taken place. Continuous strip 21 is shown here as a magazine cartridge with holes 8, 9*a*, and 9*b* formed and insert 30 already attached, so that insert 30 is bent together with strip 21. FIG. 12 shows second hinge part 20 (which is the same embodiment shown in FIG. 3) after bending operations have been performed on continuous strip 21. The reference letters apply to segments of the continuous strip 21 in its flat state before bending (FIG. 11) and in its desired shape after bending (FIG. 12). Segments A, B, and C, correspond to first end 22 of continuous strip 21 shown in FIG. 3. Segments H, G, F, and E correspond to second end 23, and segment D corresponds to bent section 24. More specifically, segment C corresponds to first section 25 of FIG. 3, segment C correspond to second section 26, segment A corresponds to third section 27 and segment H corresponds to at least a portion of fourth section 28.

Insert 30 may be attached to segment A of continuous strip 21 before the bending operation and forming of hole 9*a*, as shown in FIG. 11, such as by welding. Although, the insert is preferably bent in a separate operation and inserted into position after bending has been performed on continuous strip 21. Preferably holes 8, 9*a* and 9*b* are formed in continuous strip 21 before bending is performed, such as by drilling. Hole 9*a* may be formed through both segment A and insert 30 in a single operation, if the insert 30 has been previously attached to continuous strip 21. Otherwise a hole corresponding to hole 9*a* will be formed in insert 30 in a separate operation. The magazines can be cut from one another or from a large sheet using a saw cut, a laser or a water jet. They may be zinc plated before or after bending. After bending, holes 9*a* and 9*b* in continuous strip 21 (and hole 9*a* in insert 30) are aligned with one another and form hole 9 in FIG. 12. Depending on the dimensions of longitudinal opening 5 and bolt 40, (see FIG. 3), it may be desired to insert bolt 40 into hole 8 before the bending operation is completed.

Figure 4:
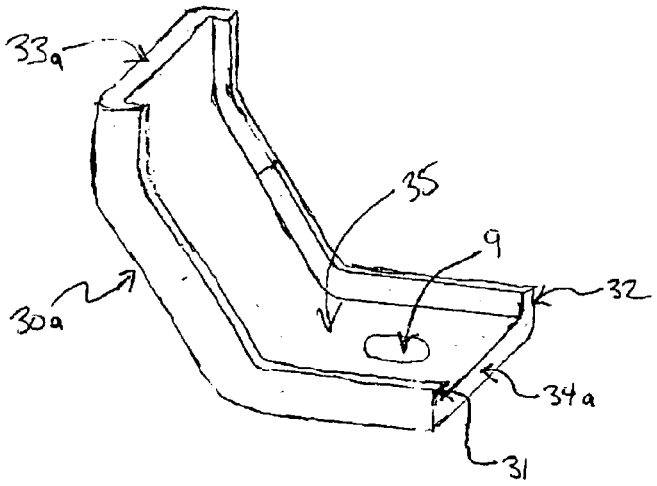
FIG. 4 shows an alternative embodiment of an insert for the vehicle door hinge shown in FIG. 3.

In an alternative embodiment, an insert 30*a* may be used in place of insert 30, which includes flanged portions 31 and 32, as shown in FIG. 4. A further alternative embodiment, insert 30*b* is shown in FIG. 14. The flanged portions 31, and 32 of insert 30*a* extend perpendicular to upper surface 35 and may be formed by bending side portions of the insert upward with respect to surface 35. The flanged portions shown in FIG. 4 extend from a second end 34*a* for the entire length of the insert 30*a* to first end 33*a*. Alternatively, the insert may only include one flanged portion 31 or 32, or flanges that are bent in a downward direction with respect to surface 35, or flanges which extend along a lesser portion of the length of the insert 30*a* (as with insert 30*b* of FIG. 14). In an assembled configuration, the flanged portions preferably abut against at least a portion of the first end 22 (or, alternatively the second end 23) of continuous strip 21, thereby imparting additional strength and rigidity to the second hinge part, particularly with respect to a angular deflection of the hinge.

The second hinge part 20 shown in FIG. 3 also includes at least two holes 8 and 9 adapted to receive bolts 40, 41 respectively, or other appropriate attachment devices for mounting the hinge part 20 to the vehicle 70. In this embodiment, the first hole 8 passes through the second end 23 of the continuous strip 21 at a region within the longitudinal opening. This position of first hole 8 (and first bolt 40) with respect to hinge axis 2, provides good resistance to angular deflection of the hinge, for example, in an over-open condition of the door. The second hole 9 passes through the third and fourth sections 27, 28 of the continuous strip 21 and through the insert 30. Because of the limited space available within the longitudinal opening 5, in the embodiment shown in FIG. 3, it may be preferable to insert bolt 40 into hole 8 at a time before the continuous strip 21 is bent to form the longitudinal opening 5.

Figure 5:
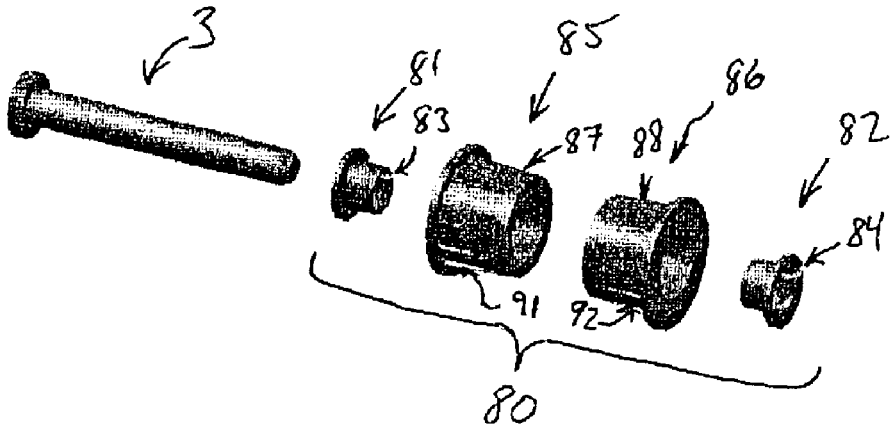
FIG. 5 shows a first embodiment of a hinge pin and hinge pin insertion component.
Figure 6:
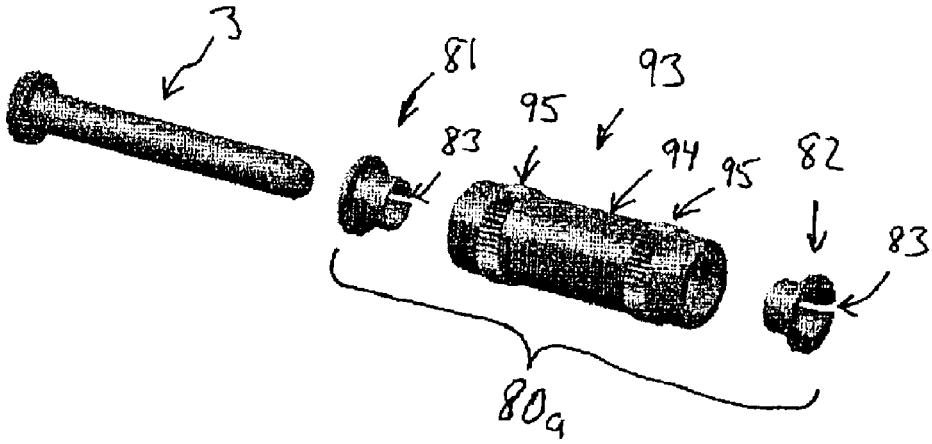
FIG. 6 shows a second embodiment of a hinge pin and hinge pin insertion component.

Depending on the manufacturing process, the tolerances of an inside diameter of longitudinal pin aperture 6 formed by bending of the continuous strip may be sufficiently tight for the pin 3 without any additional measures. However, to achieve better control of the inside diameter dimension, a hinge pin insertion component 80 or 80*a* may be provided to be inserted into the pin aperture 6. FIGS. 5 and 6 show two exemplary embodiments of hinge pin insertion components 80 and 80*a*, respectively.

According to FIG. 5, the insertion component 80 includes two aperture bearing elements 85 and 86 having outside surfaces 87 and 88. The aperture bearing elements are sized to fit within the longitudinal pin aperture 6 of the second hinge part 20. The outside surfaces 87 and 88 may be tapered toward the inside to ensure a tight fit within the longitudinal pin aperture 6 despite tolerance variances of the inside diameter of the longitudinal pin aperture 6. The outside surfaces 87 and 88 may also include ribs 91 and 92 to help prevent undesired rotational movement of the aperture bearing elements 87 and 88 within the longitudinal pin aperture 6 after they are fully inserted. The hinge pin insertion component 80 shown in FIG. 5 also includes two pin bearing elements 81 and 82, each adapted to be inserted inside of one of aperture bearing elements 87 and 88, respectively. Pin bearing elements 81 and 82 each have an inside diameter adapted to fit to an outside diameter of the hinge pin 3 so that the hinge pin 3 may rotate within the pin bearing elements 81 and 82. Slots 83 and 84 allow slight deformation of pin bearing elements 83 and 84 during insertion into the inside of aperture bearing elements 85 and 86. The hinge pin insertion components 80, 80*a* in both FIGS. 5 and 6 may be made of any suitable materials, such as metal or plastic, which provide sufficient strength, rigidity and can be fabricated to close tolerances.

FIG. 6 shows an alternative hinge pin insertion component 80*a*, wherein the aperture bearing elements 83 and 84 of insertion component 80 are replaced by sleeve 93. Sleeve 93 includes outside surface 94, which is sized to fit tightly within longitudinal pin aperture 6 of hinge part 20. Outside surface 94 includes two serrated regions 95. The serrations of regions 95 stick up slightly above the rest of outside surface 94 and thereby help to provide a tight fit within pin aperture 6 despite tolerance variances and to prevent undesired rotational movement of sleeve 93 within pin aperture 6. Pin bearing elements 81 and 82 are adapted to be inserted into the ends of sleeve 92 and to receive the hinge pin 3 as described in the embodiment of FIG. 6.

Figure 7:
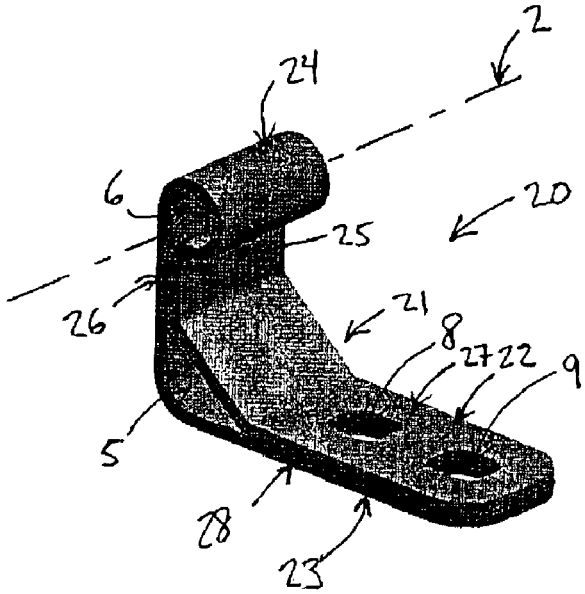
FIG. 7 shows an alternative embodiment of the second hinge part for the vehicle door hinge.

FIG. 7 shows an alternative embodiment of second hinge part 20, which also includes continuous strip of material 21 that has a bent section 24 arranged between first and second ends 22, 23. Bent section 24 is formed so as to create longitudinal pin aperture 6 about hinge axis 2. First end 22 includes first section 25, which is parallel to second section 26 of second end 23 at a region adjacent to the longitudinal pin aperture 6. First end also includes third section 27 and second end includes fourth section 28, wherein third and fourth sections 27 and 28 are parallel to one another and may be welded to one another. Triangular longitudinal opening 5 is formed by a portion of the first end 22 (between first and third sections 25 and 27) and a portion of the second end 23 (between second and fourth sections 26 and 28). Compared with the embodiment shown in FIG. 3, parallel third and fourth sections 27 and 28 are longer, and no insert is provided between first and second ends 22, 23. The length of third and fourth sections 27 and 28 is sufficient to allow for first and second holes 8 and 9 to be formed in the portion of the hinge part outside of longitudinal opening 5. Both holes 8 and 9 pass through first and second ends 23 of continuous strip 21.

Figure 8:
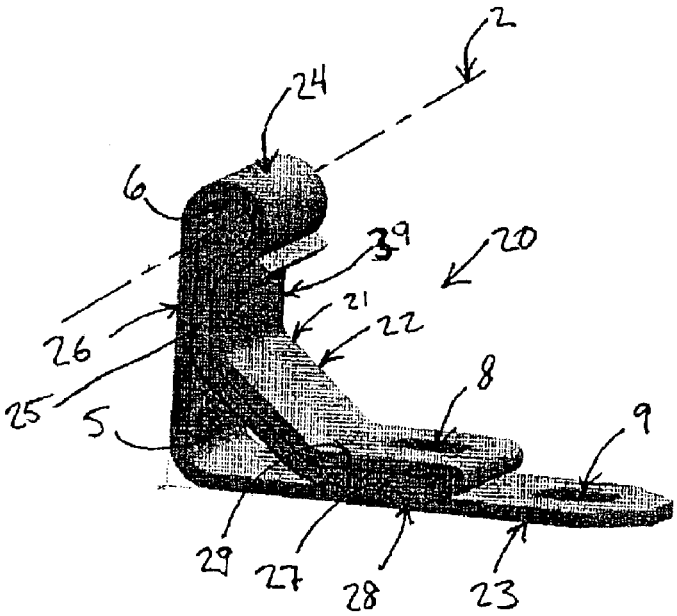
FIG. 8 shows a further alternative embodiment of the second hinge part for the vehicle door hinge.

FIG. 8 shows a further alternative embodiment of second hinge part 20 according to the present invention. Like the previously described embodiments, second hinge part 20 includes continuous strip of material 21 having bent section 24 arranged between first and second ends 22, 23. Bent section 24 is formed so as to create longitudinal pin aperture 6 about hinge axis 2. First end 22 includes first section 25, which is parallel to second section 26 of second end 23 at a region adjacent to the longitudinal pin aperture 6. Second hinge part also includes a triangular longitudinal opening 5 adjacent longitudinal pin aperture 6. First end 22 includes third section 27 and second end 23 includes fourth section 28, wherein third and fourth sections 27 and 28 are parallel to one another and fixed to one another at a region adjacent to the triangular longitudinal opening 5. Like the embodiment of FIG. 7, both first and second holes 8 and 9 are formed in a region of the continuous strip 21 outside the triangular longitudinal opening 5. Unlike the embodiment of FIG. 7, third section 27 does not terminate flush with the end of fourth section 28 of first end 22. Instead, first end 22 includes fifth section 29 which is bent over third section 27 and runs parallel to third section 27. First end 22 also includes sixth section 39 which is parallel to first section 25 at a region adjacent the pin aperture 6. Fifth and sixth sections 29, 39 of first end 22 are preferably fixed to third and first sections 27, 25 respectfully, for example by laser welding. In this embodiment, first end 22 of continuous strip 21 terminates adjacent to bent section 24. In this configuration, first hole 8 is formed through fifth and third sections 29, 27 of first end 22 and through the fourth section 28 of second end 23. Second hole 9 is formed through only second end 22. The configuration of FIG. 8 is advantageous in that it provides a strong hinge part using relatively thin material, and does not require an insert for additional strength.

Figure 9:
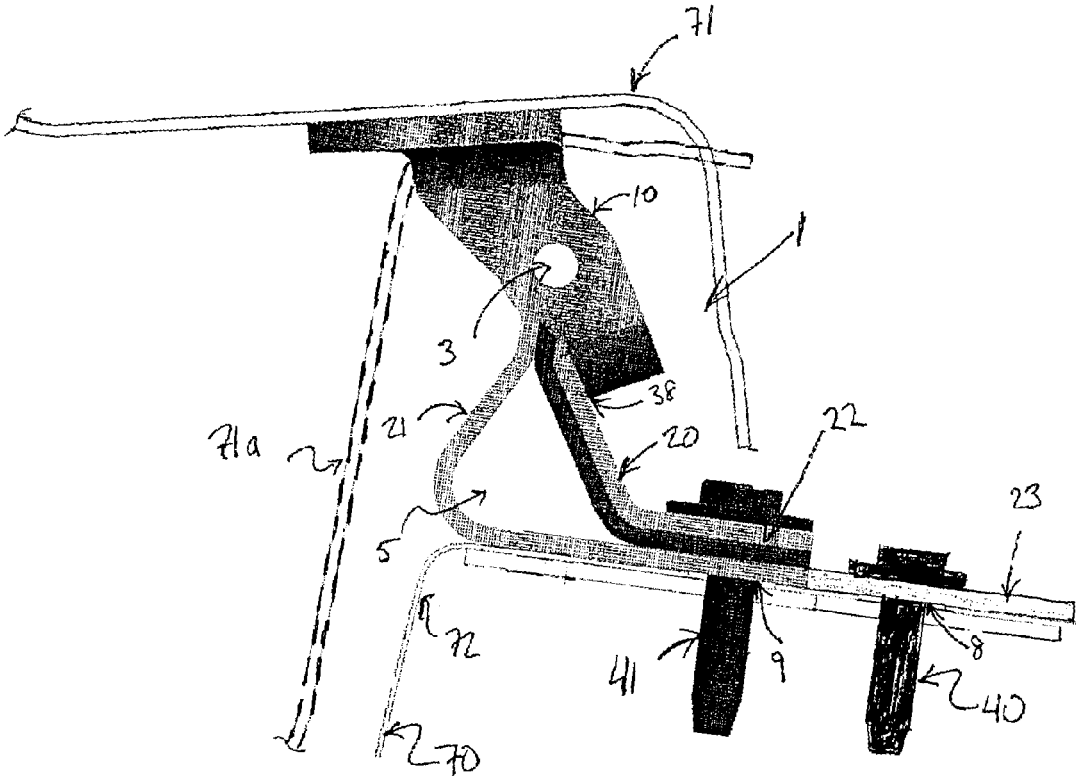
FIG. 9 shows yet a further alternative embodiment of the second hinge part for the vehicle door hinge.

FIG. 9 shows a further alternative embodiment of second hinge part 20 together with first hinge part 10. This embodiment differs from the embodiment shown in FIGS. 1 and 3 in that the second end 23 of continuous strip 21 extends beyond first end 22, and first hole 8 is located outside of the region of longitudinal opening 5 and in the portion of second end 23 that extends beyond first end 22 (to the right of second hole 9 in FIG. 9). First hole 8 passes through second end 23 and receives first bolt 40 or other appropriate attachment device. This embodiment, with an extended second end 22 allows easier access to hole 8 and may be preferred in situations in which more space is available for mounting second hinge part 20 to the vehicle (or vehicle door, as the case may be).

Figure 10:
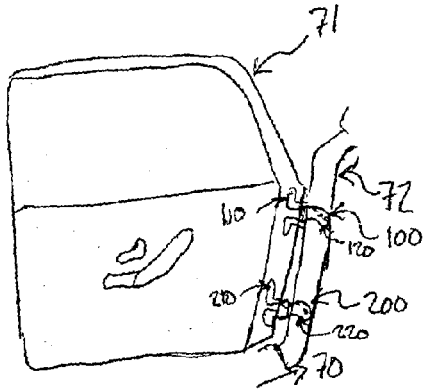
FIG. 10 shows a vehicle door having two hinges according to the present invention.

Typically, the hinge according to the present invention is used for a vehicle passenger side door, though it can also be used for other vehicle doors, such as a lift gate. For a passenger door, typically two hinges are used to provide adequate support for the door. FIG. 10 shows a schematic view of a vehicle door 71 in an open position with respect to vehicle body 72 of vehicle 70. Two hinges 100, and 200 are shown connecting the door to the vehicle body. Hinge 100 includes first hinge part 110 mounted to the door and second hinge part 120 mounted to the vehicle body. Likewise hinge 200 includes first hinge part 210 mounted to the vehicle door and second hinge part 220 mounted to the vehicle body. Hinges 100 and 200 and can include one or more of the embodiments described herein. It is also conceivable that only one of the hinges 100 and 200 will be of the type described herein, while the other may be another type of hinge.

It will of course be understood that the present invention has been described above only by way of example and that modifications of details can be made within the scope of the invention.

What is claimed is:

1. A method for manufacturing a vehicle door hinge having a hinge axis, comprising:

providing a first hinge part having a U-shaped portion including a first arm defining a first plane and a second arm axially spaced from the first arm and defining a second plane, the hinge axis passing through the first arm and the second arm;

bending a strip of material to form a second hinge part having a first end of said strip, a second end of said strip, and a bent strip section between the first end and the second end, the first end having a first section and the second end having a second section, the first section and the second section being parallel relative to one another;

fixing the first section and the second section relative to one another; and disposing the bent section between the first and second arms about the hinge axis.

2. The method as recited in claim 1, connecting the first and second arms to the bent section using a hinge pin disposed along the hinge axis.

3. The method as recited in claim 2, further comprising providing a fixed inner diameter for the hinge pin using a hinge pin insertion component disposed in the bent section.

4. The method as recited in claim 1, wherein the bending and the fixing are performed so as to provide a longitudinal opening distinct from said bent section and defined by the first end and second end adjacent the first and second sections.

5. The method as recited in claim 4, wherein the bending is performed so that the longitudinal opening is triangular.

6. The method as recited in claim 1, further comprising providing an insert between the first end and second end.

7. The method as recited in claim 6, further comprising fixing the first section, second section, and insert together.

8. The method as recited in claim 6, wherein the insert is made of different material than the strip of material.

9. The method in claim 8, wherein the strip of material is made of steel.

10. The method as recited in claim 9, wherein the insert is made of a first grade of steel and the strip of material is made of a higher grade of steel.

11. The method as recited in claim 6, further comprising forming a flange on the insert and wherein the providing of the insert includes disposing the flange around at least one of the first end and the second end.

12. The method as recited in claim 6, wherein the bending is performed so that the bent section and an end of the insert form a cylinder about the hinge axis.

13. The method as recited in claim 1, further comprising welding the first and second sections to each other.

14. The method as recited in claim 1, further comprising attaching one of the first and second hinge parts to the door.

15. The method as recited in claim 14, further comprising forming a first hole in the first end, forming a second hole in the second end and wherein the attaching is performed using a first attachment device passing through the first hole and the second hole.

16. The method as recited in claim 15, wherein forming include forming the first hole in the first section and forming the second hole in the second section.

17. The method as recited in claim 15, further comprising forming a further hole in the first end for receiving a second attachment device.

18. The method as recited in claim 17, further comprising forming a second further hole in the second end has for receiving the second attachment device.

19. The method as recited in claim 15, wherein the bending is performed so as to provide a longitudinal opening defined by the first end and second end adjacent the first and second section and further comprising forming a further hole in the first end opening into the longitudinal opening.

20. The method as recited in claim 14, wherein the attaching is performed using a bolt.

21. The method as recited in claim 1,wherein the strip of material has a thickness of 4 mm or less.

22. A method for making a vehicle door hinge having a hinge axis, comprising:

providing a first hinge part having a first arm and a second arm axially spaced from the first arm, the first and second arms each including an edge surface and an other surface that is broader than the respective edge surface, the hinge axis passing through the other surfaces of the first and second arms;

bending a strip of material so as to create a second hinge part, the bending being performed so as to form a first section defining an aperture about the hinge axis between a first and second end of said strip, and so as to create a second section connected to the first section and defining a longitudinal opening with a longitudinal axis offset from and parallel to the hinge axis; and connecting the first hinge part with the second hinge part using a hinge pin disposed along the hinge axis.

23. The method as recited in claim 22, wherein the bending is performed so that longitudinal opening is triangular.

24. The method as recited in claim 22, wherein the strip of material has a thickness of 4 mm or less.

25. A method for making a vehicle hinge having a hinge axis, comprising:

providing a first hinge part having a U-shaped portion including a first arm and a second arm axially spaced from the first arm, the hinge axis passing through the first and second arms;

bending a strip of material so as to form a second hinge part having a bent section about the hinge axis intermediate to a first end of said strip and a second end of said strip, and having a longitudinal opening distinct from the bent section;

disposing an insert between the first end and the second end; and connecting the first hinge part with the second hinge part using a hinge pin disposed along the hinge axis.

26. The method as recited in claim 25, wherein the strip of material has a thickness of 4 mm or less.

27. The method as recited in claim 25, wherein the strip of material extends into said longitudinal opening.

28. A method for manufacturing a vehicle door hinge having a hinge axis, comprising the steps of:

providing a first hinge part having an intermediate section and a first arm extending from the intermediate section and a second arm extending from the intermediate section and being parallel to and axially spaced from the first arm, the hinge axis passing perpendicularly through the first arm and the second arm;

roll-forming a strip of material so as to form a second hinge part having a first end, a second end, and a bent section between the first end and the second end, the bent section defining an aperture; and disposing the bent section between the first and second arms so that the hinge axis passes through the aperture and so that the second hinge part is rotatable with respect to the first hinge part.

29. The method as recited in claim 28, wherein the strip of material has a thickness of 4 mm or less.

30. The method as recited in claim 28 further comprising mounting the second hinge part to a vehicle body so that the hinge axis is vertical.

* * * * *